US011596279B2

(12) United States Patent
Bodman

(10) Patent No.: US 11,596,279 B2
(45) Date of Patent: Mar. 7, 2023

(54) SWIVEL COMMODE CHAIR

(71) Applicant: Mobb Health Care Ltd Corporation, Concord (CA)

(72) Inventor: Moshe Bodman, Toronto (CA)

(73) Assignee: Mobb Health Care Ltd Corporation

( * ) Notice: Subject to any disclaimer, the term of this patent is extended or adjusted under 35 U.S.C. 154(b) by 0 days.

(21) Appl. No.: 17/707,103

(22) Filed: Mar. 29, 2022

(65) Prior Publication Data

US 2022/0313033 A1 Oct. 6, 2022

Related U.S. Application Data

(60) Provisional application No. 63/167,892, filed on Mar. 30, 2021.

(51) Int. Cl.
*A47K 11/04* (2006.01)

(52) U.S. Cl.
CPC ..... *A47K 11/04* (2013.01)

(58) Field of Classification Search
CPC ..... A47K 11/04; A47K 11/06
USPC ..... 4/560.1
See application file for complete search history.

(56) References Cited

U.S. PATENT DOCUMENTS

| | | | | |
|---|---|---|---|---|
| 3,405,411 | A | 10/1968 | William | |
| 3,574,242 | A | 4/1971 | Trowbridge | |
| 3,969,778 | A | 7/1976 | Richards | |
| 4,196,480 | A | 4/1980 | Guenther et al. | |
| 4,343,052 | A | 8/1982 | Guenther | |
| 4,715,069 | A | 12/1987 | James | |
| 4,824,170 | A | 4/1989 | Goldmeier | |
| 4,882,791 | A | 11/1989 | Kimes | |
| 4,971,392 | A | 11/1990 | Young | |
| D319,303 | S | 8/1991 | Barrett, Sr. | |
| 5,078,451 | A | 1/1992 | Sobel | |
| D336,682 | S | 6/1993 | Francke et al. | |
| 5,479,668 | A | 1/1996 | Cooper | |
| 5,966,750 | A * | 10/1999 | Polanco | A61G 5/1002 4/480 |
| 6,212,695 | B1 | 4/2001 | Arduini | |
| 6,302,483 | B1 | 10/2001 | Ricaud | |
| 6,349,423 | B1 | 2/2002 | Kelleher | |
| 6,418,571 | B1 * | 7/2002 | Cheng | A61G 5/1002 297/188.09 |
| RE37,927 | E | 12/2002 | Fitch | |
| 6,890,033 | B1 | 5/2005 | Casella | |
| D526,135 | S | 8/2006 | Murphy | |
| D544,235 | S | 6/2007 | Chen | |

(Continued)

FOREIGN PATENT DOCUMENTS

| | | |
|---|---|---|
| DE | 10136218 | 5/2003 |
| JP | 2006109893 | 4/2006 |

*Primary Examiner* — Christine J Skubinna
(74) *Attorney, Agent, or Firm* — Greg M. Popowitz; Assouline & Berlowe, P.A

(57) ABSTRACT

A swivel commode chair, including a base, where the base includes an opening, a stationary frame, where the base is rotatably connected to the stationary frame, a number of elongated members extending downward from the stationary frame, and a bucket removably connected to the stationary frame. A method of a person using a swivel commode chair, including sitting on a base of the swivel commode chair, and depositing human waste through an opening in the base into a bucket removably connected to the swivel commode chair.

20 Claims, 19 Drawing Sheets

(56) References Cited

U.S. PATENT DOCUMENTS

| | | | | |
|---|---|---|---|---|
| D622,974 | S | 9/2010 | Igarashi | |
| 8,074,306 | B2 * | 12/2011 | Chien | A47K 3/122 4/578.1 |
| 8,402,572 | B2 | 3/2013 | Herasimtschuk | |
| 8,627,518 | B1 * | 1/2014 | Lederer | A47K 11/04 4/441 |
| 9,072,384 | B2 | 7/2015 | Saint Pierre | |
| 9,375,090 | B2 | 6/2016 | Gambino | |
| D799,702 | S | 10/2017 | Wong | |
| D800,319 | S | 10/2017 | Wong | |
| D817,019 | S | 5/2018 | Borrelli | |
| 11,304,530 | B1 * | 4/2022 | Lin | A61G 5/00 |
| 2002/0117878 | A1 | 8/2002 | Fox | |
| 2006/0179558 | A1 * | 8/2006 | Dupuis | A61G 7/1007 4/254 |
| 2009/0140564 | A1 | 6/2009 | Tseng | |
| 2012/0030870 | A1 * | 2/2012 | Storm | A61G 5/1002 280/47.38 |
| 2013/0022482 | A1 | 1/2013 | Schober | |
| 2014/0252824 | A1 | 9/2014 | Saint Pierre | |
| 2015/0182402 | A1 * | 7/2015 | Nelson | A61G 7/1007 4/479 |
| 2020/0095757 | A1 * | 3/2020 | Schwab | E03D 11/125 |
| 2020/0337920 | A1 * | 10/2020 | Hansen | A61G 5/006 |

* cited by examiner

SWIVEL COMMODE CHAIR

CROSS-REFERENCE TO RELATED APPLICATIONS

This patent application claims the benefit under 35 U.S.C. § 119(e) of U.S. Provisional Patent Application No. 63/167,892, filed Mar. 30, 2021, which application is incorporated herein by reference.

FIELD OF THE INVENTION

The invention broadly relates to a swivel commode chair, including a base, where the base includes an opening, a stationary frame, where the base is rotatably connected to the stationary frame, a number of elongated members extending downward from the stationary frame, and a bucket removably connected to the stationary frame, and even more particularly to a method of a person using a swivel commode chair, including sitting on a base of a swivel commode chair, and depositing human waste through the opening in the base into a bucket removably connected to the swivel commode chair.

BACKGROUND OF THE INVENTION

People with short-term injuries, long-term injuries, or that are elderly often have mobility issues that prevent them from walking or travelling to a typical bathroom with toilets. While catheters can help a person urinate while in bed, a person still has trouble when they have to expel excrement (feces).

Presently, bed pans are used for bedridden patients or people that cannot travel to the bathroom. However, using a bed pan is often hard for a person to use independently, often relying on a nurse or other person to aid in the process. Using a bedpan can be quite embarrassing and humiliating for someone to use due to the assistance required to go to the bathroom.

In some cases, a person is able to move from the bed but cannot travel to the bathroom. Being able to exit the bed gives the patient the ability to use the bathroom in a standard manner, i.e., sitting in an upright position on a toilet seat to expel human waste. It is normal for the patient to use a bathroom while sitting, as opposed to a catheter or bed pan while laying in a bed.

Currently, there is a need for a device that will allow people who can exit a bed to use a restroom, or pseudo restroom, while in a typical sitting position. A need exists to help people that are not mobile enough to travel to the bathroom but can exit a bed to a chair. Especially if the chair is positioned near the bed.

As can be derived from the variety of devices and methods directed at helping bedridden people expel human waste, many means have been contemplated to accomplish the desired end, i.e., catheters and bed pans. Heretofore, tradeoffs between humility and comfort were required. Thus, there is a long-felt need for a device that allows a person to sit and expel their human waste when unable to travel to a bathroom. There is a further long-felt need for a device that allows each user to expel their human waste into a bucket on a chair and have the human waste discarded. There is also a long-felt need for a method to sit on a chair to expel human waste through an opening in the chair and into a removable bucket.

BRIEF SUMMARY OF THE INVENTION

The present invention broadly comprises a swivel commode chair, including a base, where the base includes an opening, a stationary frame, where the base is rotatably connected to the stationary frame, a number of elongated members extending downward from the stationary frame, and a bucket removably connected to the stationary frame.

In a further embodiment, the swivel commode assembly includes a commode guide assembly connected to the stationary frame where the commode guide assembly supports the bucket.

It is a general object of the present invention to provide a swivel commode chair, comprising a base, an opening of the base where a removable insert is removably connected to the base to cover the opening, and a bucket slidably engaged to the base.

In a further embodiment, the top surface of the removable insert is flush with the top surface of the base when the removable insert is engaged with the base It is a general object of the present invention to provide a process where a person uses a swivel commode chair, including sitting on a base of a swivel commode chair, and depositing human waste through the opening in the base into a bucket removably connected to the swivel commode chair.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "commode" is synonymous with terms such as "bucket", "pail", "container", "vessel", etc., and such terms may be used interchangeably as appearing in the specification and claims. It should also be appreciated that the term "chair" is synonymous with terms such as "seat", "bench", "stool", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
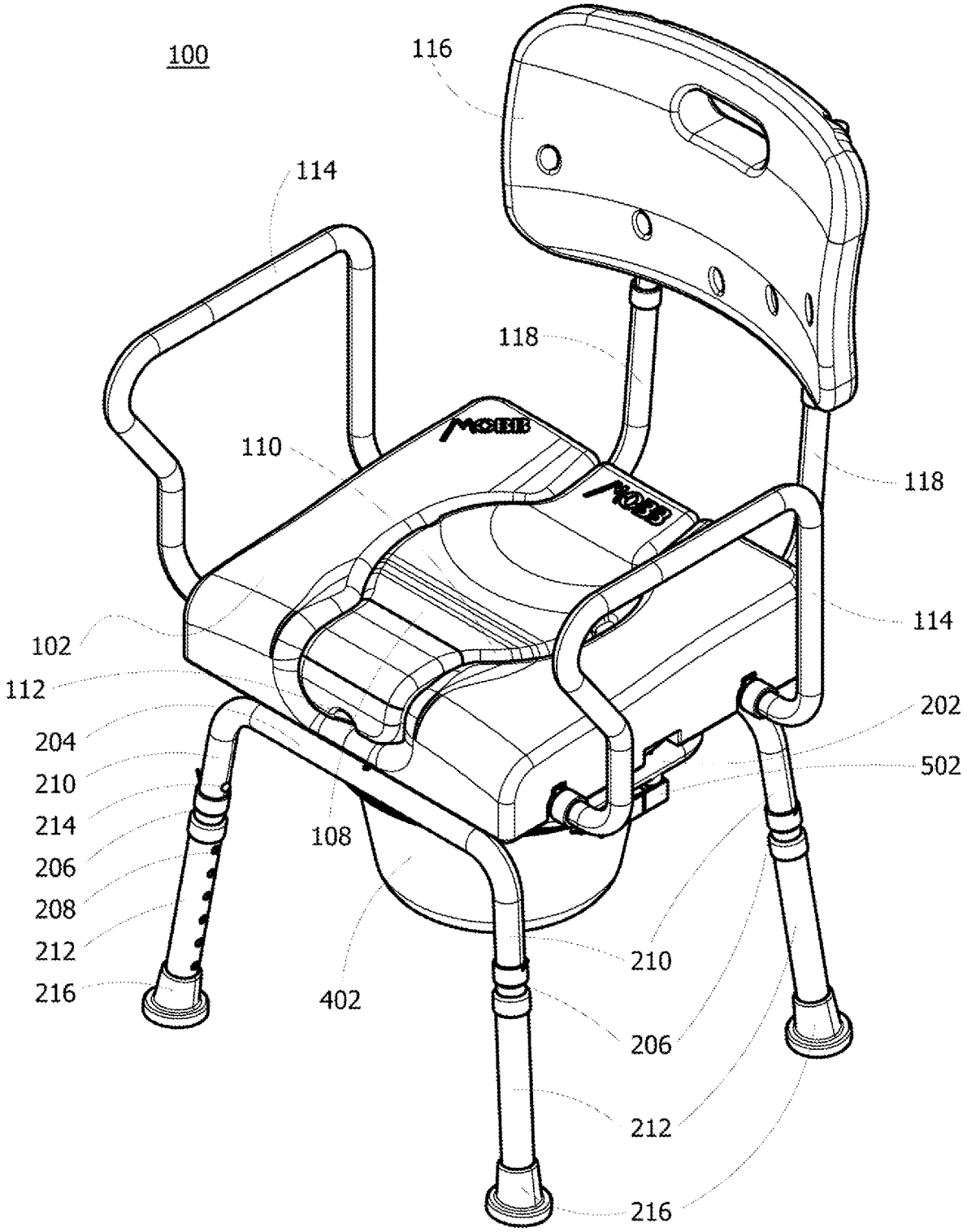
FIG. 1 is a front perspective view of the Swivel Commode Chair with the removable insert engaged on the base.
Figure 2:
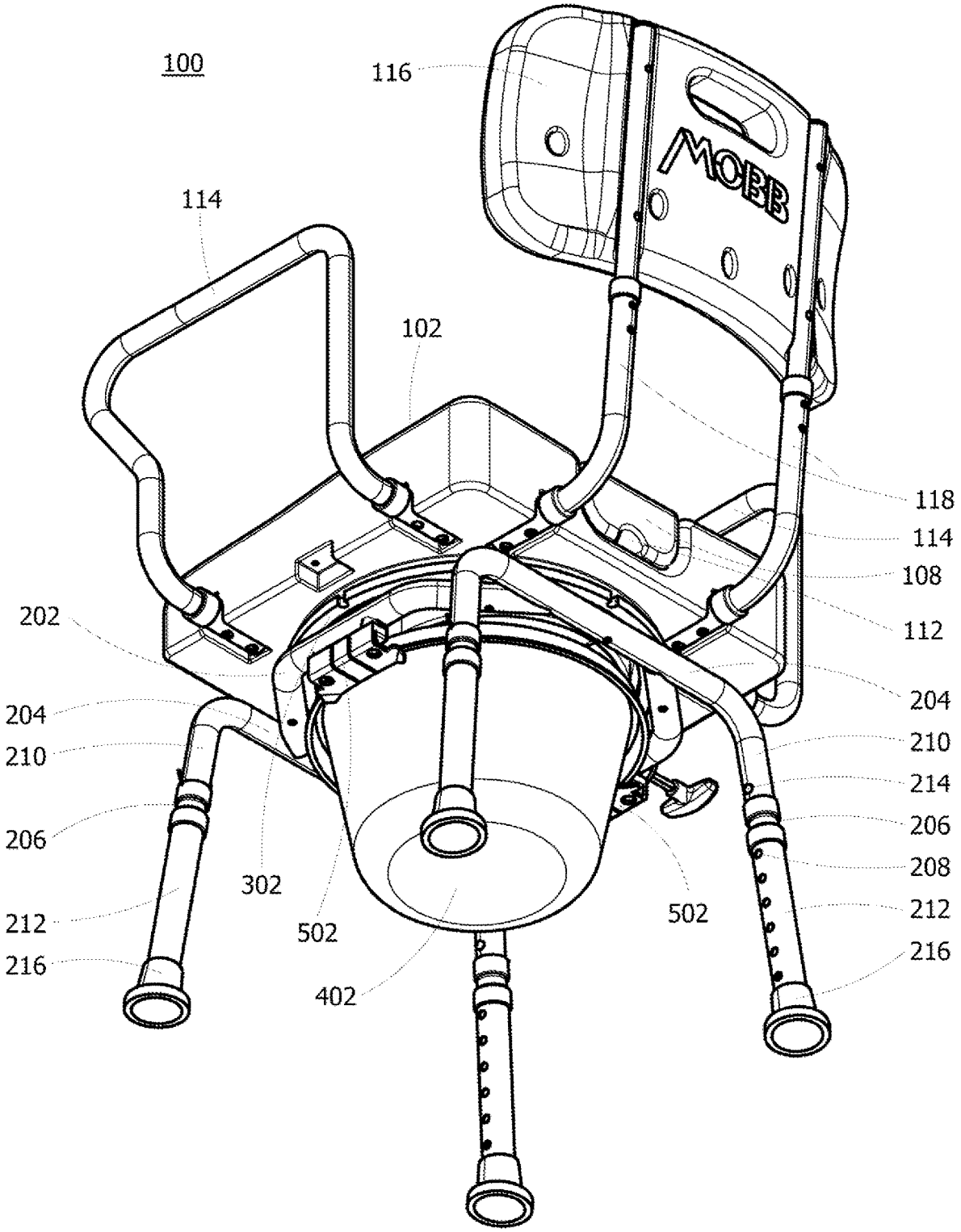
FIG. 2 is a bottom perspective view of the invention shown in FIG. 1 with the removable insert engaged on the base.
Figure 3:
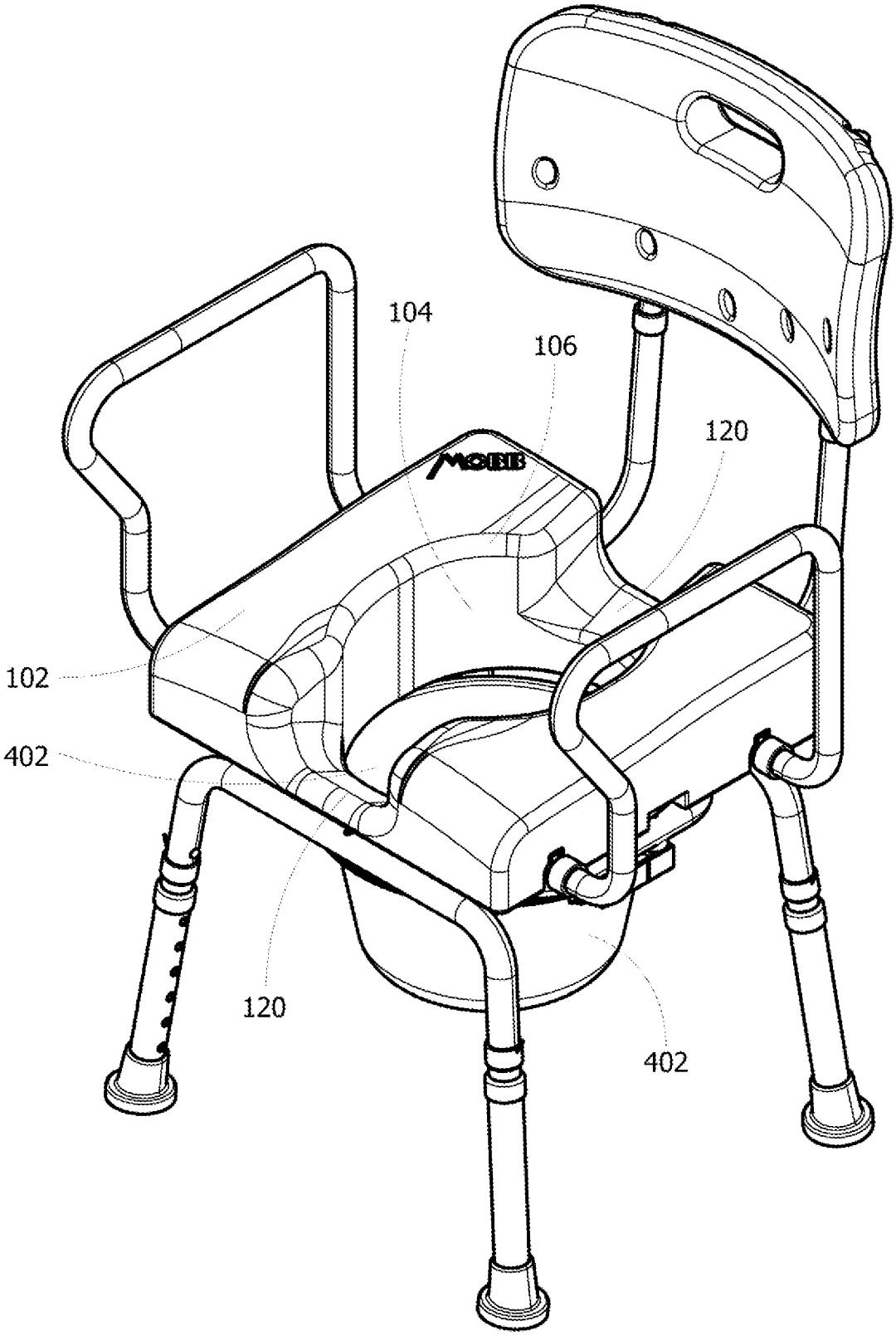
FIG. 3 is a front perspective view of the invention shown in FIG. 1 without the removable seat insert engaged on the base.

Adverting now to the figures, FIGS. 1 and 2 show the swivel commode chair 100. The swivel commode chair 100 is broken into two sections, an upper section and a lower section. The upper section includes base 102 with opening 104. Opening 104 is depicted in FIG. 3. Opening 104 extends from the front of the base where a person's legs would be, to the rear of the base. The opening 104 does not extend to the edges of the left and right sides of base 102. The edges of the opening 102 are contoured as shown at opening contour 106 in FIG. 3. The front top edge of base 102 where a person's legs hang over (see FIGS. 1 and 22) are contoured to make the sitting experience more comfortable for the user (see FIG. 1).

Figure 20:
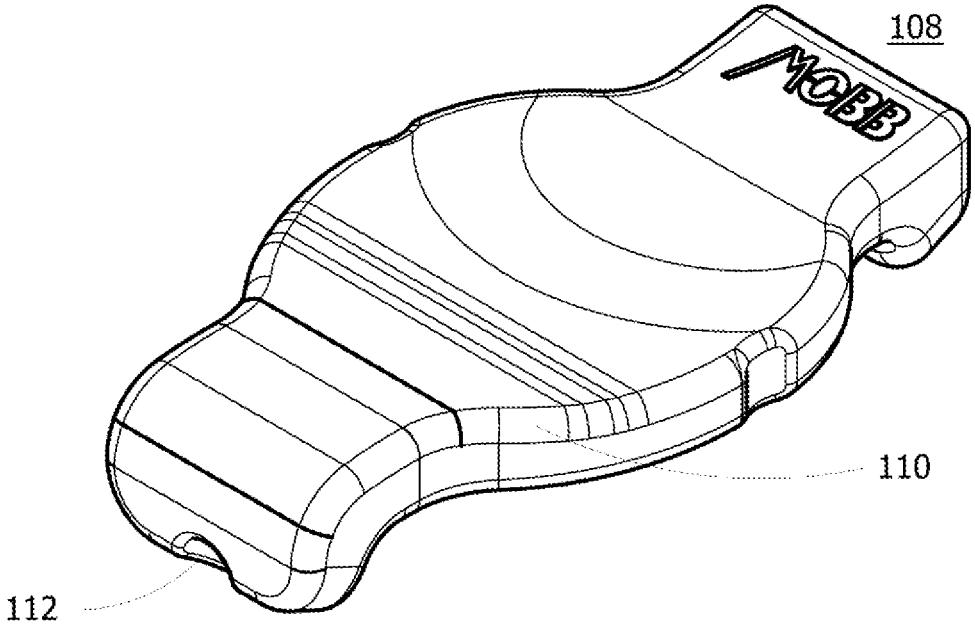
FIG. 20 is a front perspective view of the removable insert depicted in FIG. 1.
Figure 21:
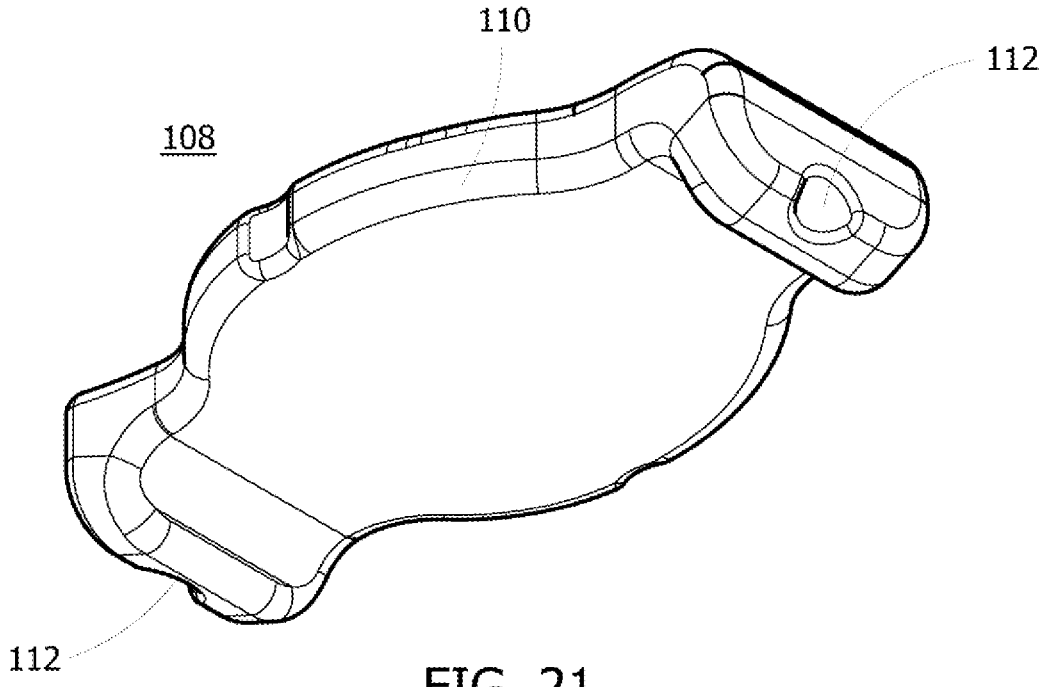
FIG. 21 is a bottom perspective view of the removable inset depicted in FIG. 1.

Also part of the upper section is removable insert 108, shown in FIGS. 1, 20, and 21. Removable insert 108 is shaped to fit the space defined by opening 104 of base 102. Removable insert 108 is designed to insert onto base 102 to fit onto opening 104 and create a flush surface for the person sitting on the base 102. When engaged, the top surface of removable insert 108 is flush with the top surface of base 102. The bottom edge of removable insert 108 is contoured, as shown by removable insert contour 110 in FIGS. 20 and 21. The removable insert contour 110 is designed to mate with the opening counter 106 when the removable insert 108 is engaged with the base 102.

Removable insert 108 also includes dimples 112 on the front and back portions of the removable insert 108. The dimples 112 provide space for a person's fingers to grasp the removable insert 108 so the person can remove the removable insert 108 from base 102, or add support for the person to place removable insert 108 onto base 102.

Figure 9:
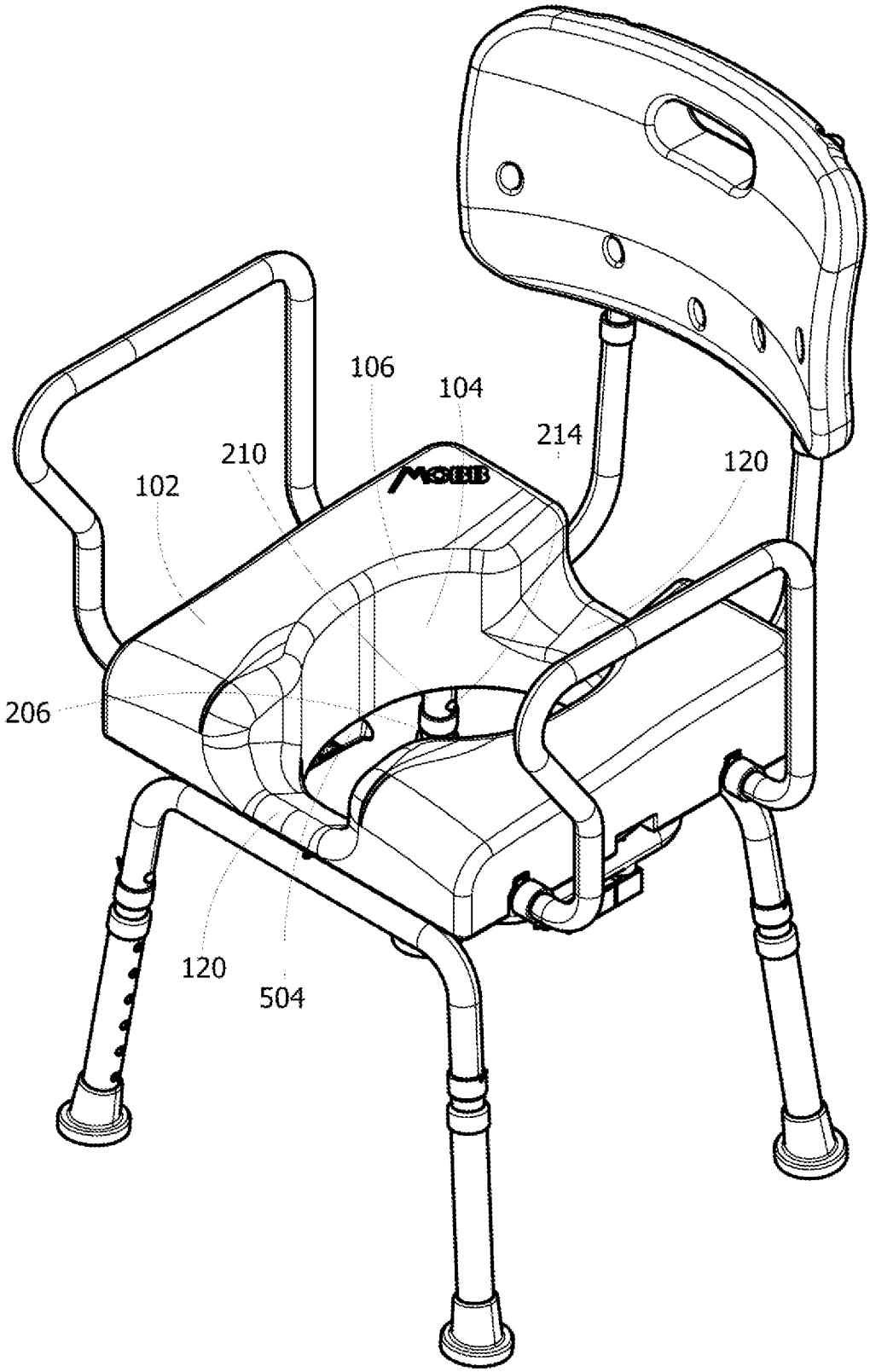
FIG. 9 is a front perspective view of the present invention without the removable insert engaged on the base and without the bucket.
Figure 22:
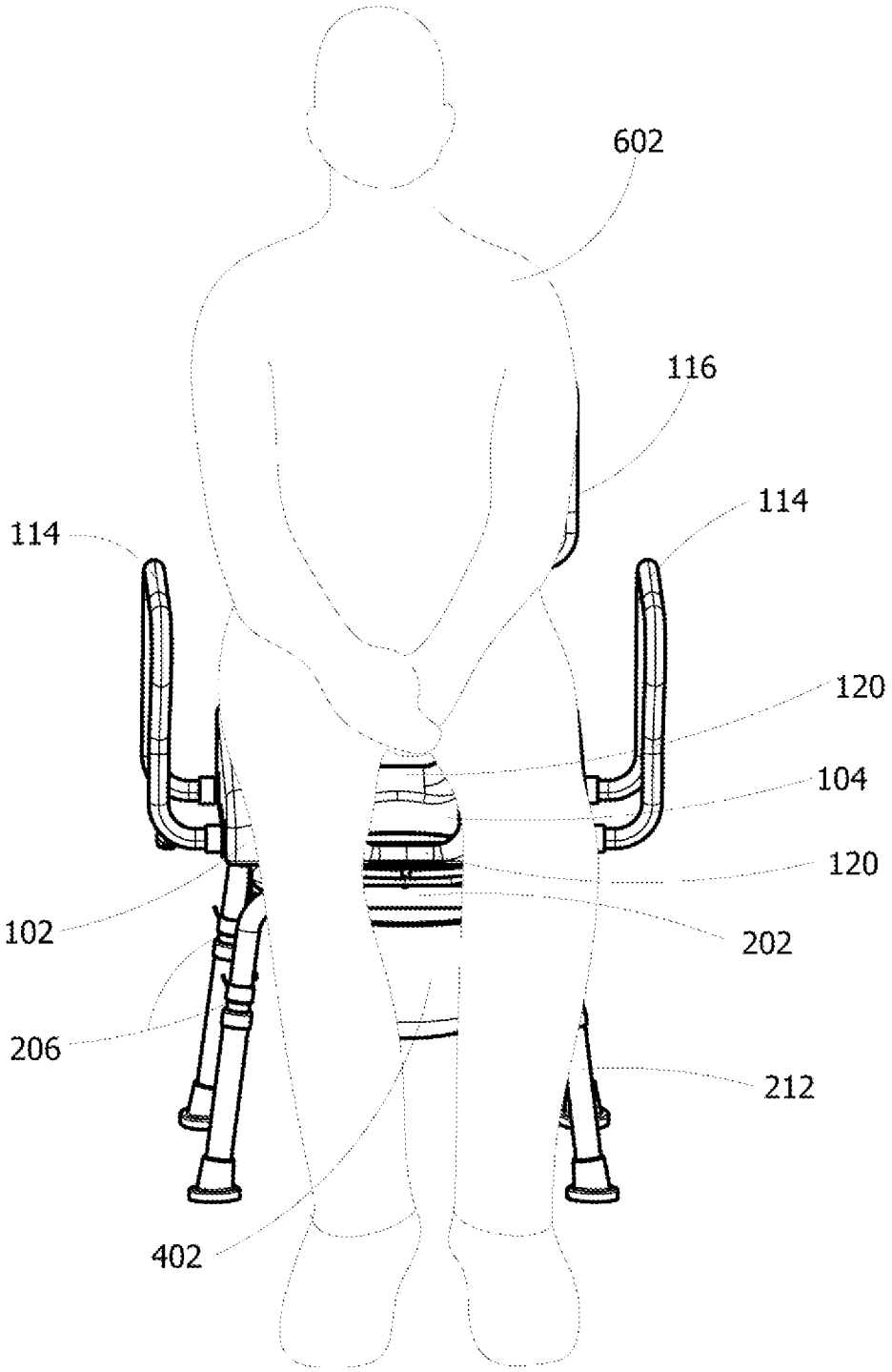
FIG. 22 is a front perspective view of a person sitting on the swivel commode chair.

When the removable insert 108 is engaged on the base 102, the base 102 and removable insert 108 act as a singular sitting surface for the person 602 sitting on the base swivel commode chair 100 (See FIG. 22). When the removable insert is not engaged on the base 102, the person 602 sits on the base and the person's buttocks and anus sit over opening 104. Opening 104 extends the full thickness of base 102, as shown in FIGS. 3 and 9.

Figure 4:
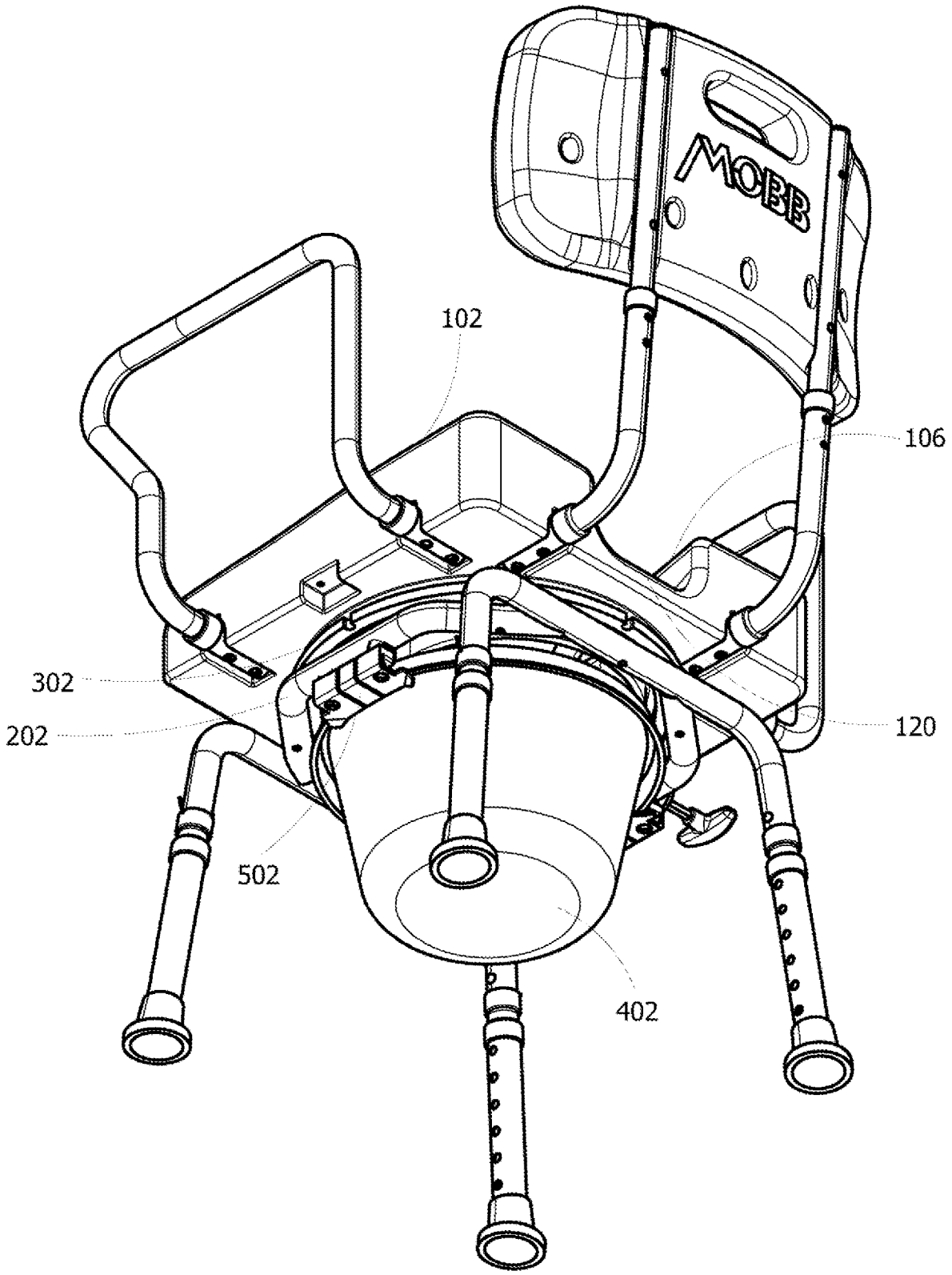
FIG. 4 is a bottom perspective view of the invention shown in FIG. 1 without the removable seat insert engaged on the base.

FIGS. 1-4 also show other elements of the upper section of the swivel commode chair 100. Arm rails 114 are positioned on the left and right sides of the base 102 to support a person's left and right arms, respectively. Arm rails 114 also provide a gripping location for a person exiting a bed to position his/her body onto the swivel commode chair 100. The two ends of arm rails 114 are secured to base 102 through the sides of base 102, as shown in FIGS. 2 and 4. Back support 116 is also connected to base 102 through back rails 118. Back support 116 is positioned to provide support for a person's back while the person is sitting on the swivel commode chair 100. Back support 116 is adjustable through the preselected positions in back rails 118, as shown in FIGS. 2 and 4. Similar to arm rails 114, back rails 118 are secured to base 102 through the back of base 102.

As shown in FIGS. 2, and 4-8, the swivel commode chair 100 includes a lower section. The lower section contains stationary frame 202 and elongated members 204 that form part of and extend downward from the stationary frame 202. Elongated members 204 include the horizontal length that connects to stationary frame 202, and legs 206 that extend downward from the horizontal length towards the floor.

Legs 206 of elongated member 204 are adjustable at adjudgment points 208. The inner leg 210 telescopes within outer leg 212 and is secured at preset locations using leg pin 214. The length of legs 206 vary based on the height and sitting preferences of the person 602 sitting in the swivel commode chair 100. At the ends of the outer legs 212 are nonslip feet 216.

Figure 5:
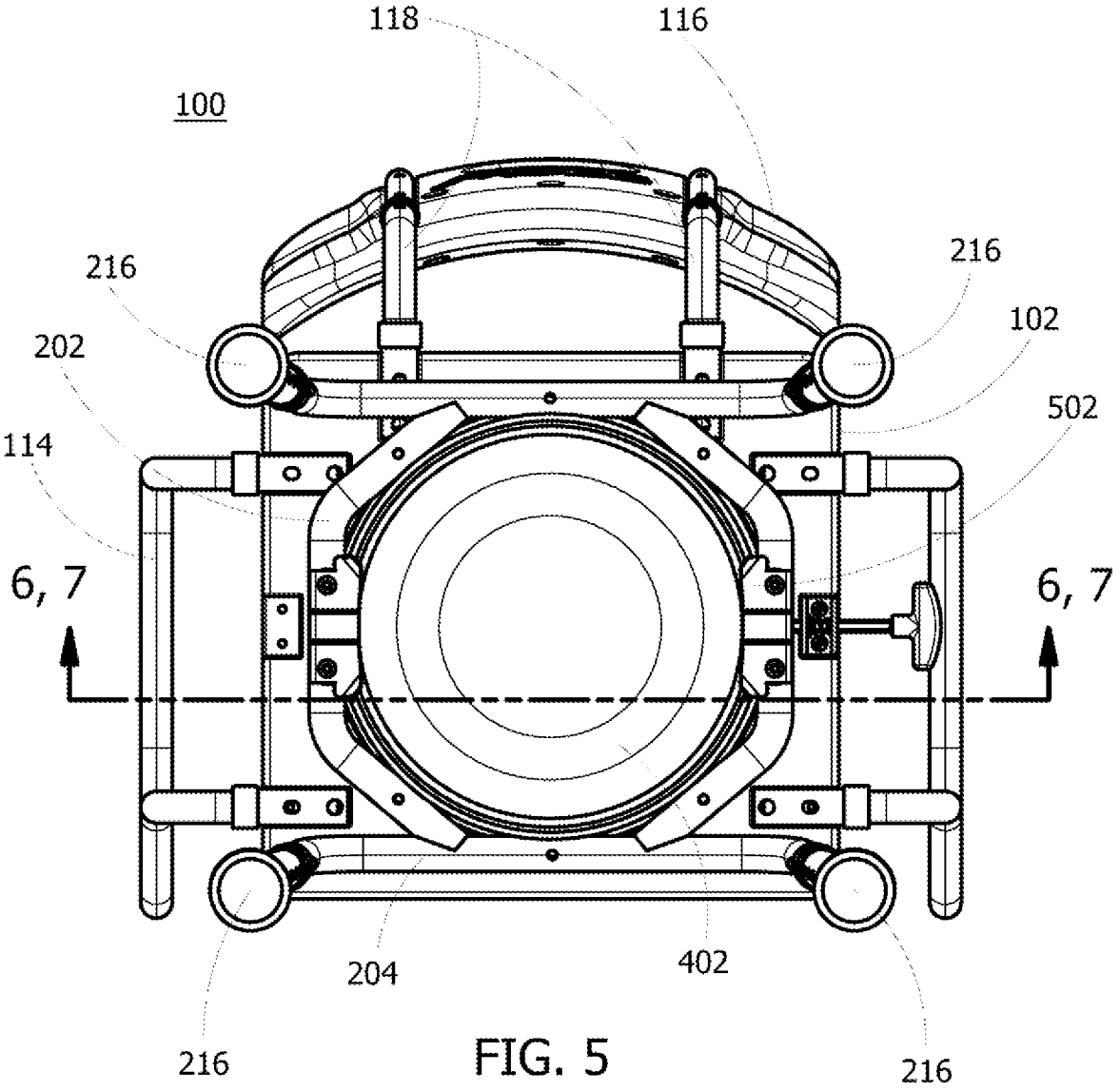
FIG. 5 is a bottom view of the invention shown in FIG. 1.
Figure 6:
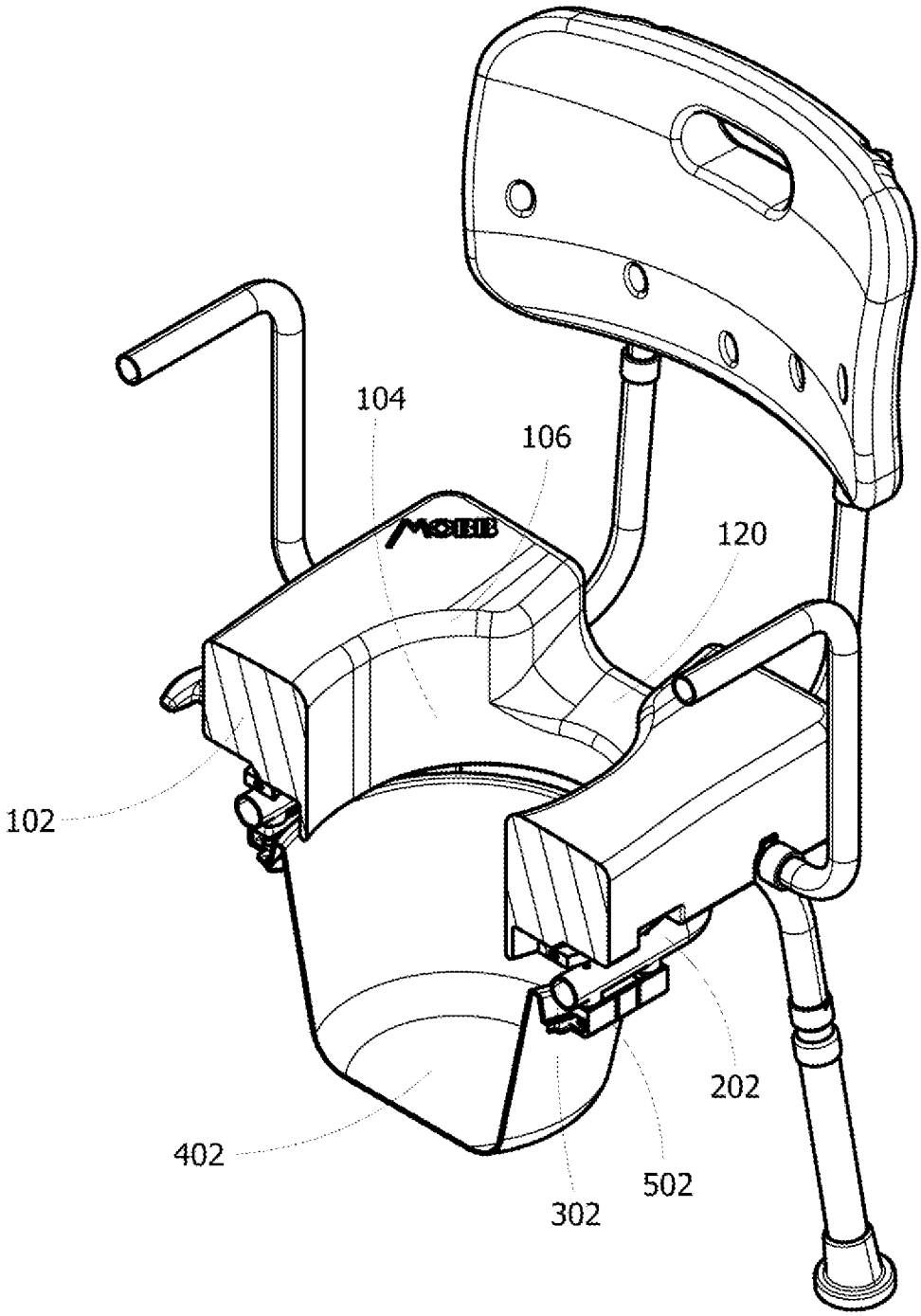
FIG. 6 is a front perspective cross section view of the invention at the location depicted in FIG. 5.
Figure 7:
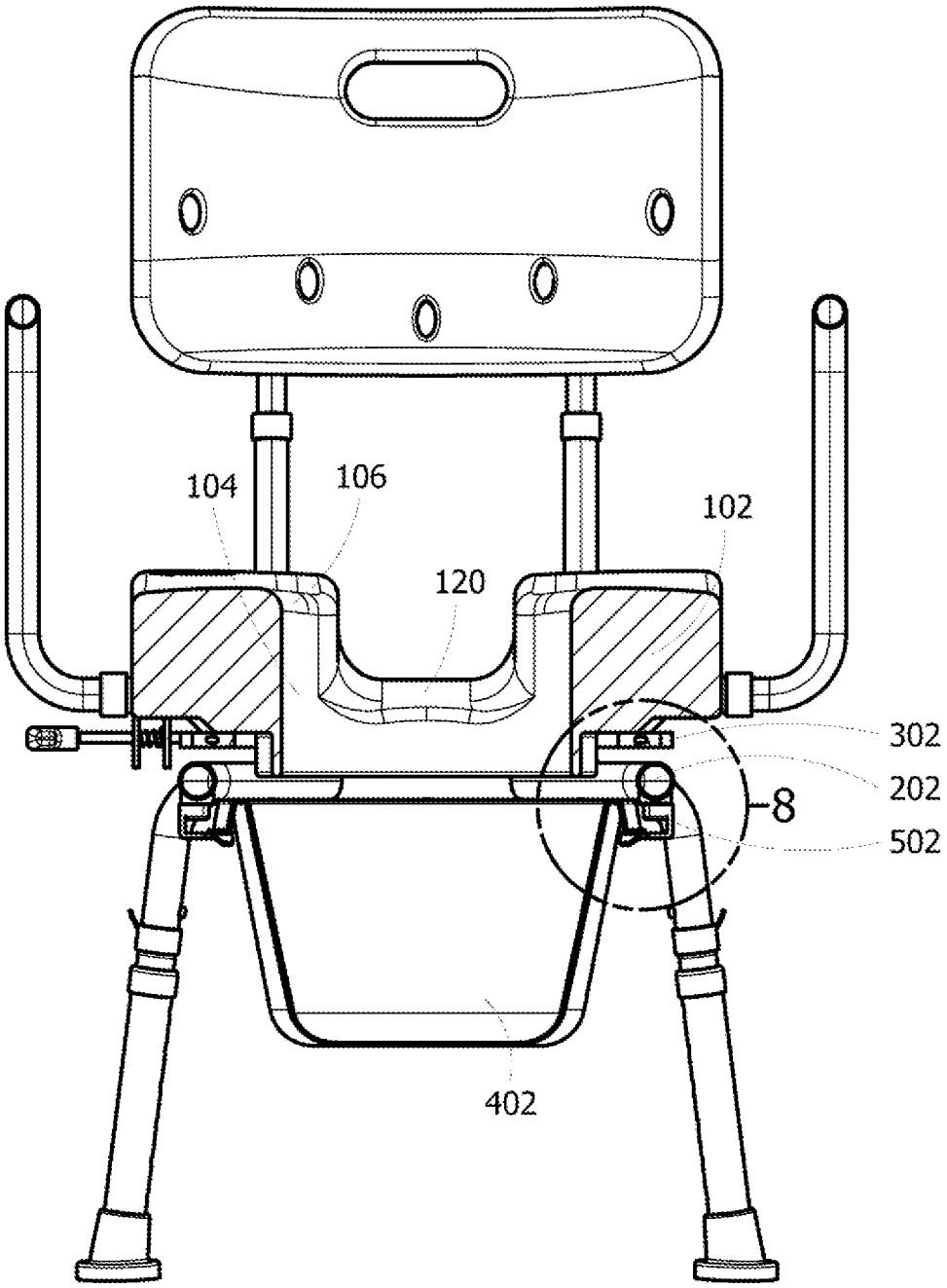
FIG. 7 is a front cross section view of the invention at the location depicted in FIG. 5.
Figure 8:
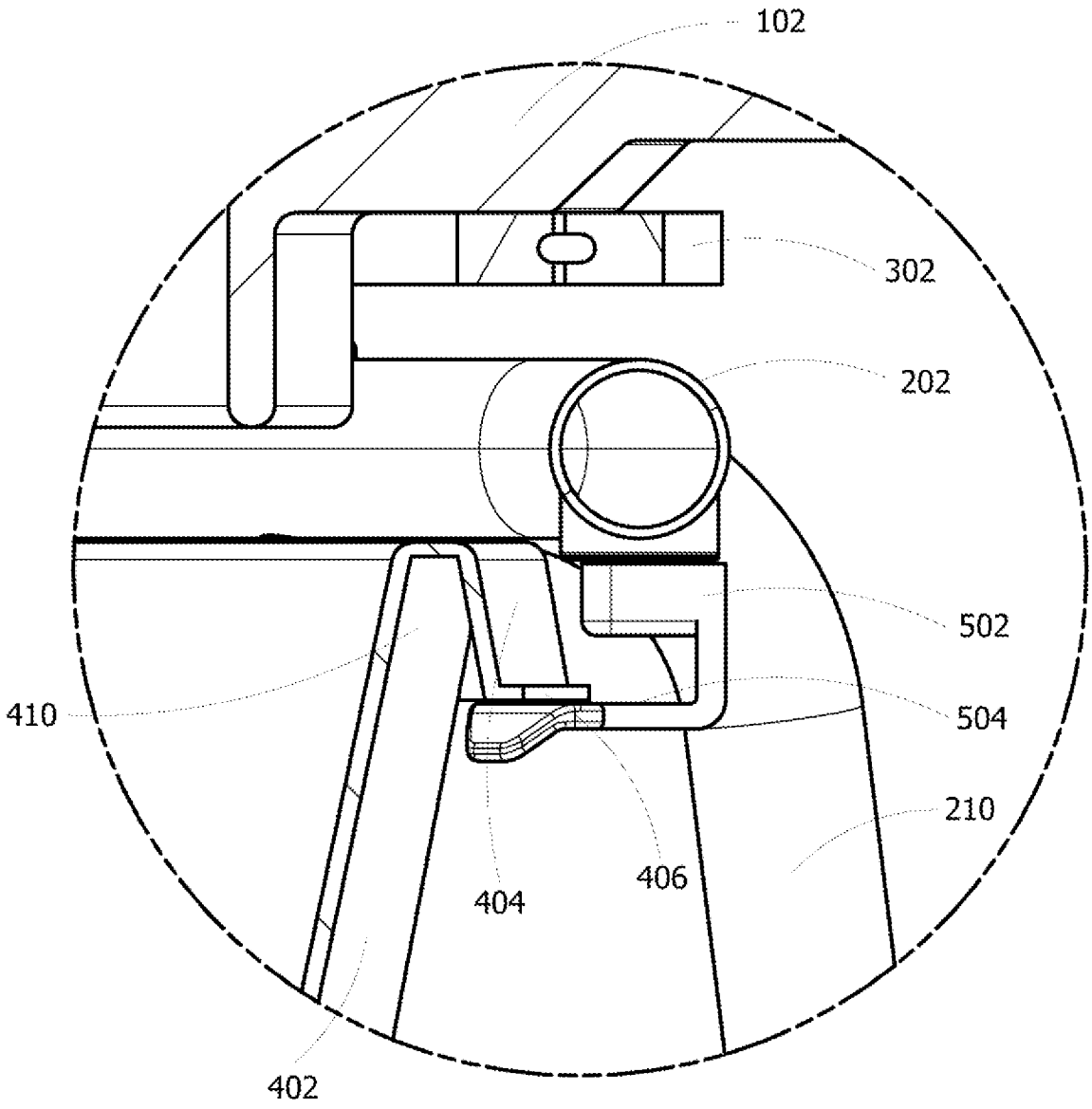
FIG. 8 is a zoomed in view of the interaction of the stationary frame and bucket as depicted in FIG. 7.

As shown in FIG. 5, the bottom of nonslip feet 216 contact the ground and prevent the swivel commode chair 100 from slipping relative to the ground. In an exemplary embodiment, the swivel commode chair 100 has four legs 206. However, varying number of legs (including one leg) can be used as long as the contact portion of the swivel commode chair 100 to the floor has sufficient surface area to stabilize the swivel commode chair 100 while a person is sitting on the base 102 with bucket 402 engaged.

Figure 10:
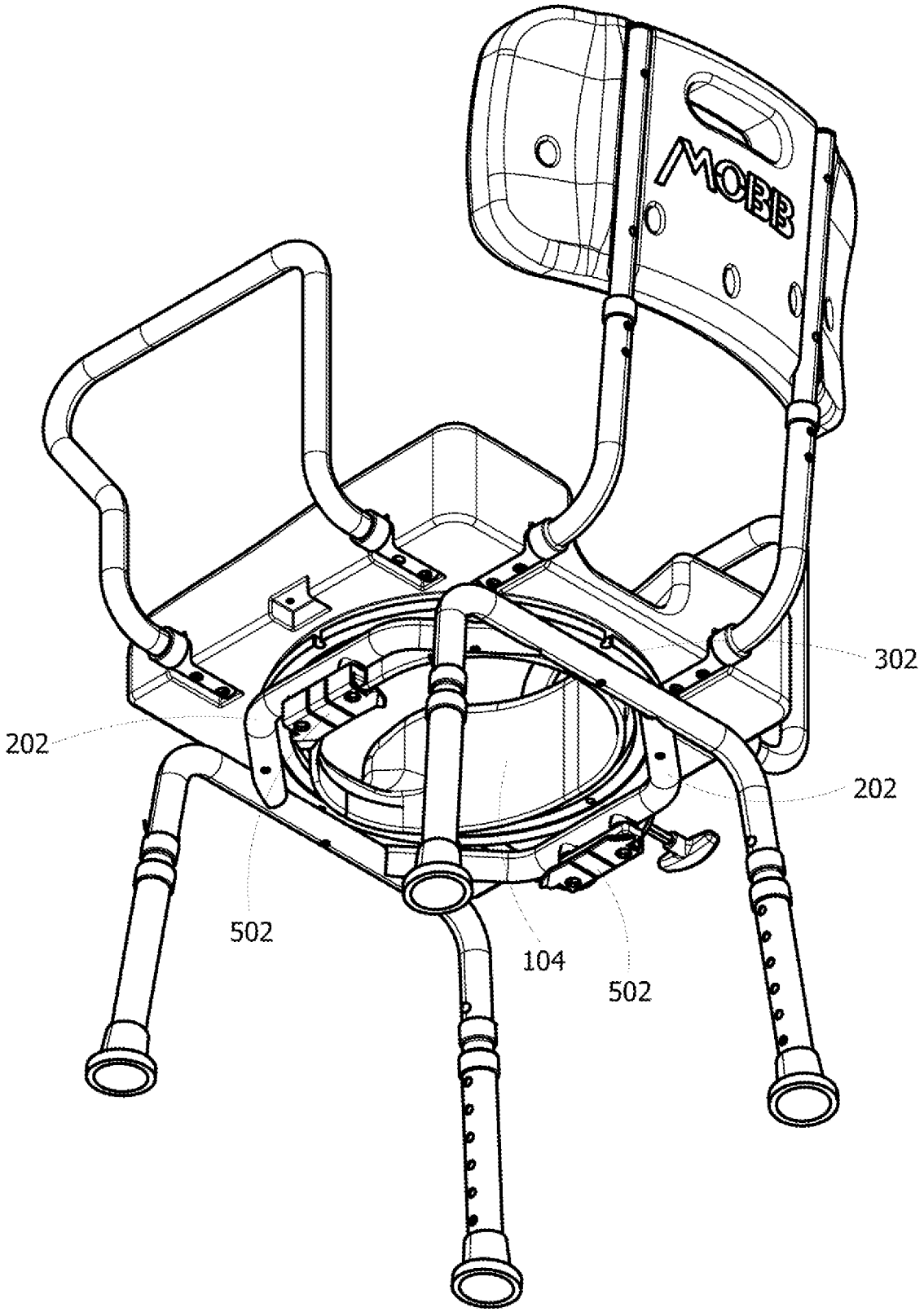
FIG. 10 is a bottom perspective view of the invention shown in FIG. 1 without the removable seat insert engaged on the base and without the bucket.
Figure 11:
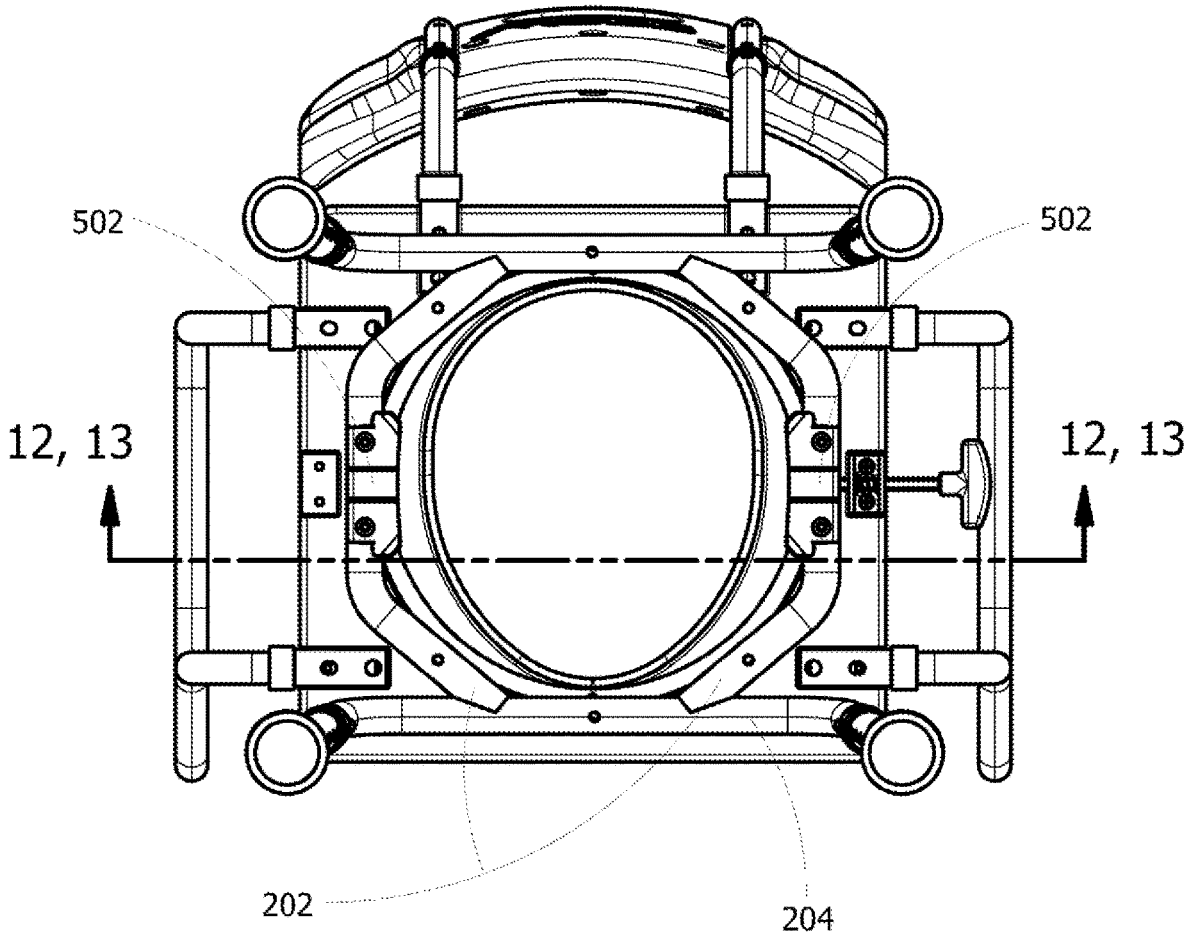
FIG. 11 is a bottom view of the invention shown in FIG. 1 without the removable seat insert engaged on the base and without the bucket.
Figure 12:
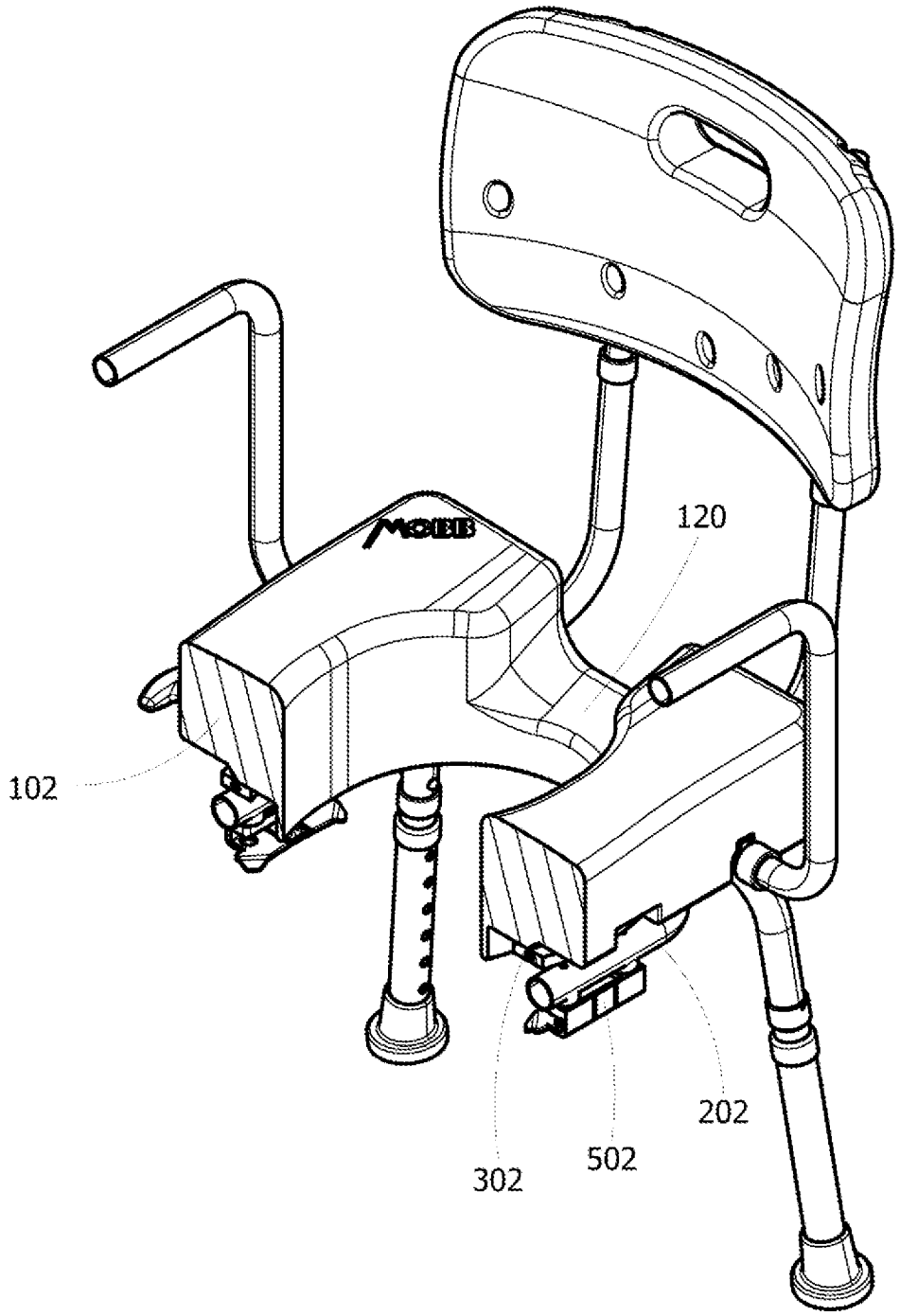
FIG. 12 is a front perspective cross section view of the invention at the location depicted in FIG. 11.
Figure 13:
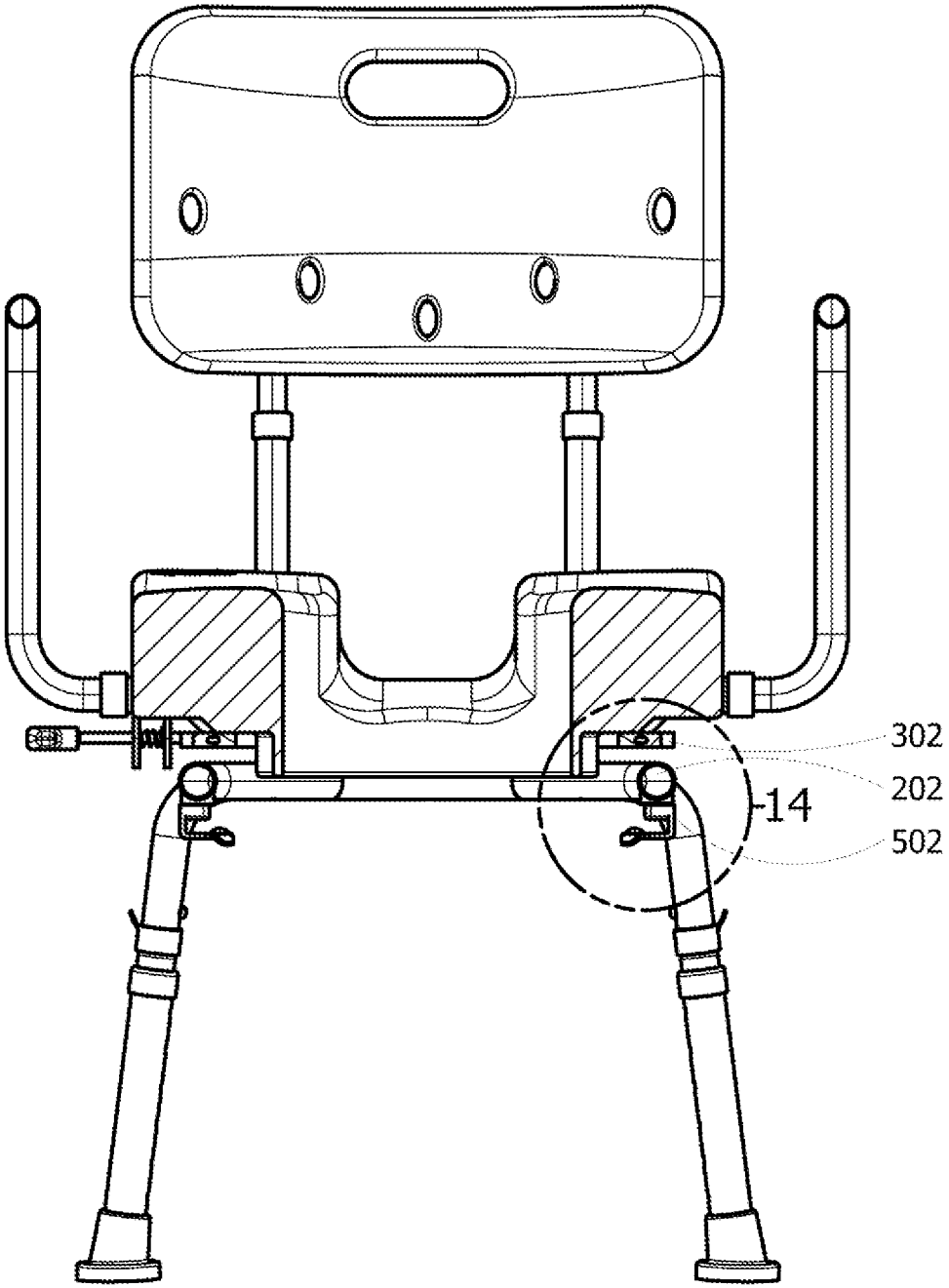
FIG. 13 is a front cross section view of the invention at the location depicted in FIG. 11.

The upper section of the swivel commode chair 100 rotates relative to the lower section. As shown in FIGS. 9 and 10, base 102 and stationary frame 202 are connected through rotatable rings 302. The rotatable nature of swivel commode chair 100 permits the person 602 sitting on the base to rotate his/her body sitting on base 102 relative to the lower section of the swivel commode chair 100. This is useful for a person 602 positioning him/herself into the swivel commode chair 100 from a bed.

The lower section of the swivel commode chair 100 also includes bucket 402, as shown in FIGS. 4, 6, and 15-17. While the term bucket 402 is used herein to describe the container of bucket 402, another term for bucket is commode. The shape of bucket 402 is cylindrical, with the bottom diameter smaller than the top diameter of bucket 402. This shape is the optimal configuration to deposit items into the bucket during use. In an exemplary embodiment, the walls of bucket 402 are parallel, with the bottom diameter substantially the same as the top diameter of bucket 402. Bucket 402 may take other geometric shapes, while the cylindrical shapes provides an efficient shape for cleaning post use of the bucket 402.

Figure 15:
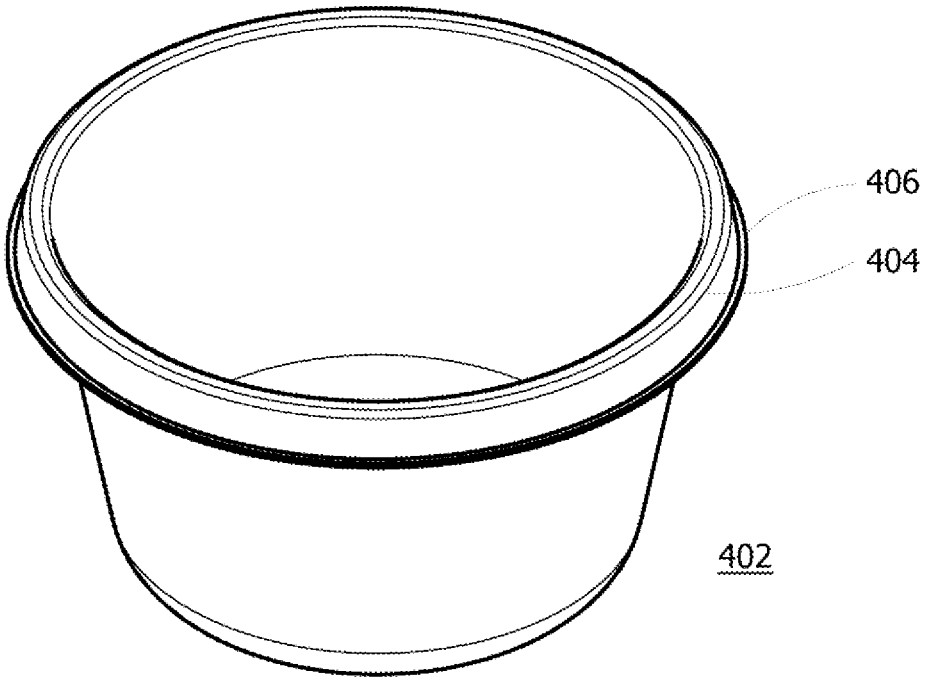
FIG. 15 is a perspective view of the bucket.
Figure 16:
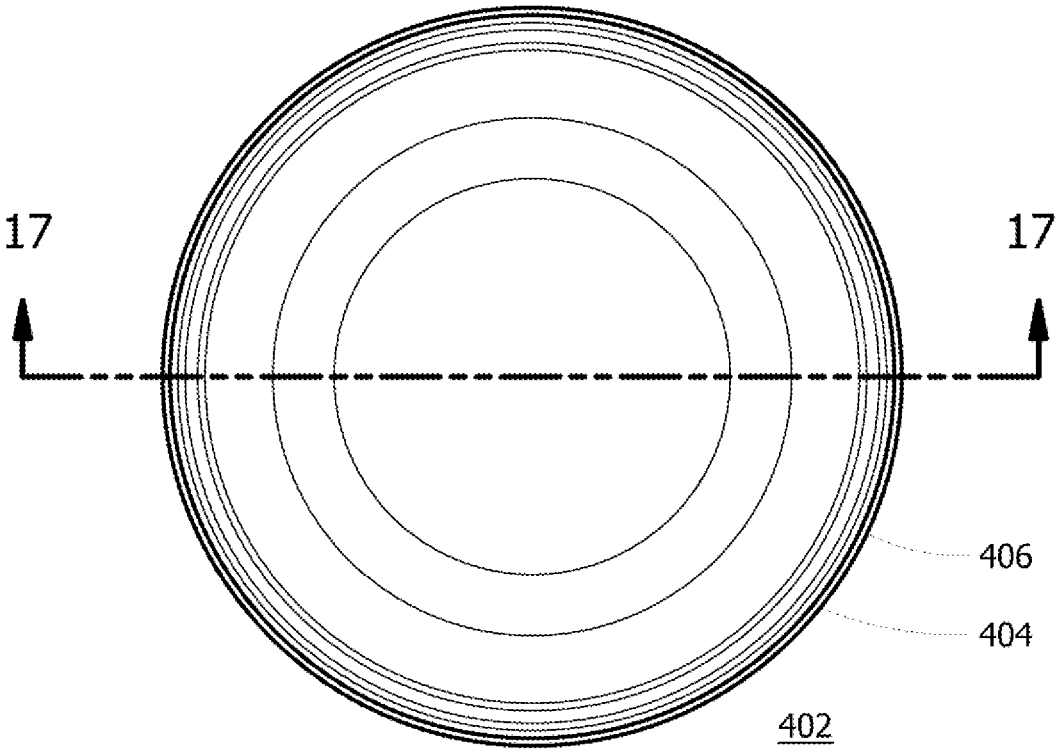
FIG. 16 is a bottom view of the bucket.
Figure 17:
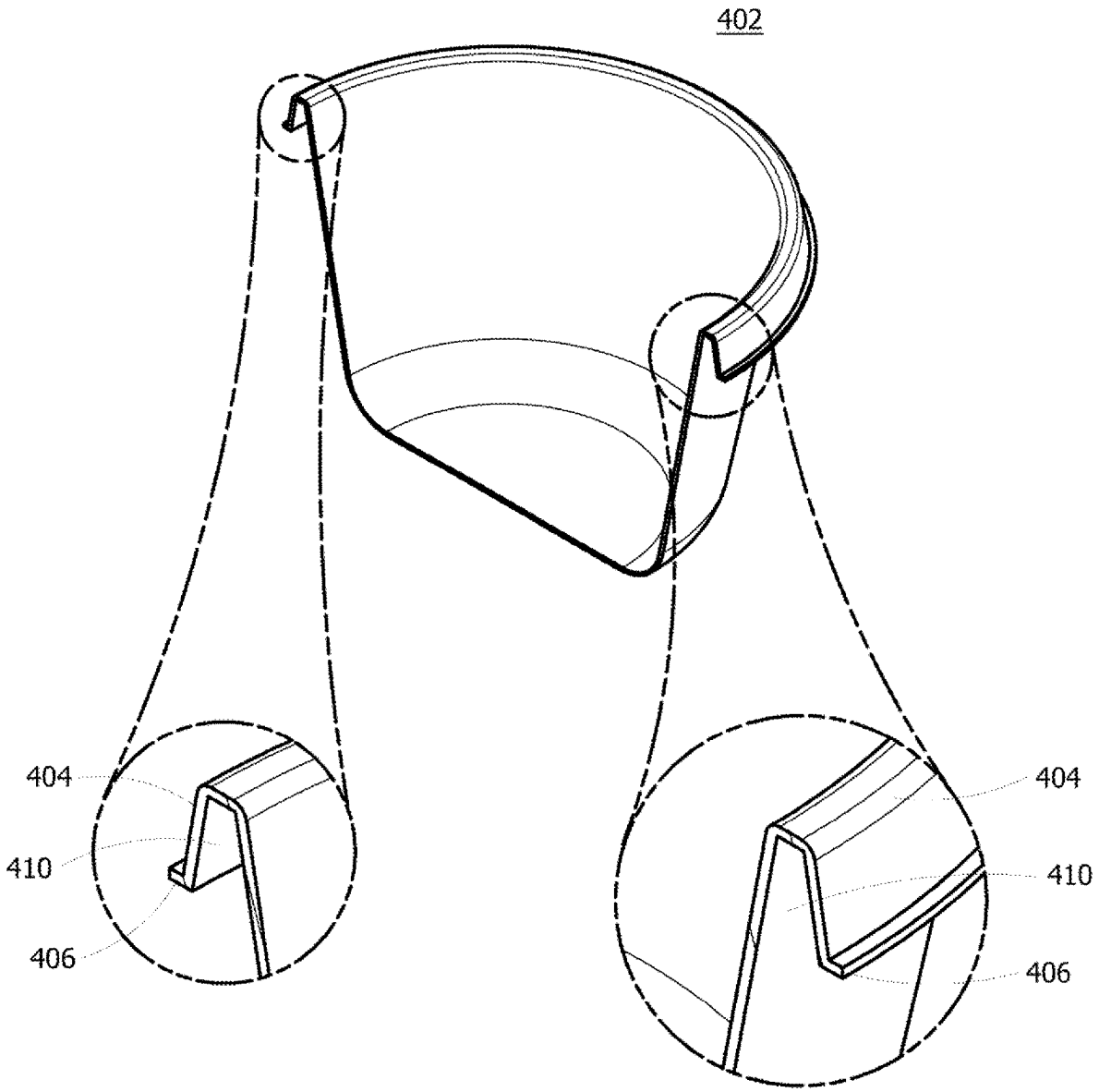
FIG. 17 is a perspective cross section view of the bucket at the location depicted in FIG. 16, showing zoomed in views of the front and rear rim of the bucket.

As shown in FIGS. 15-17, the top of bucket 402 includes rim 404 around the entire circumference of the top of bucket 402. The lower portion of rim 404 includes a flat surface labeled rim contact 406. The profile of rim 404 shown in FIG. 17 provides structural integrity of bucket 402. Rim 404 also includes rim opening 410.

Figure 14:
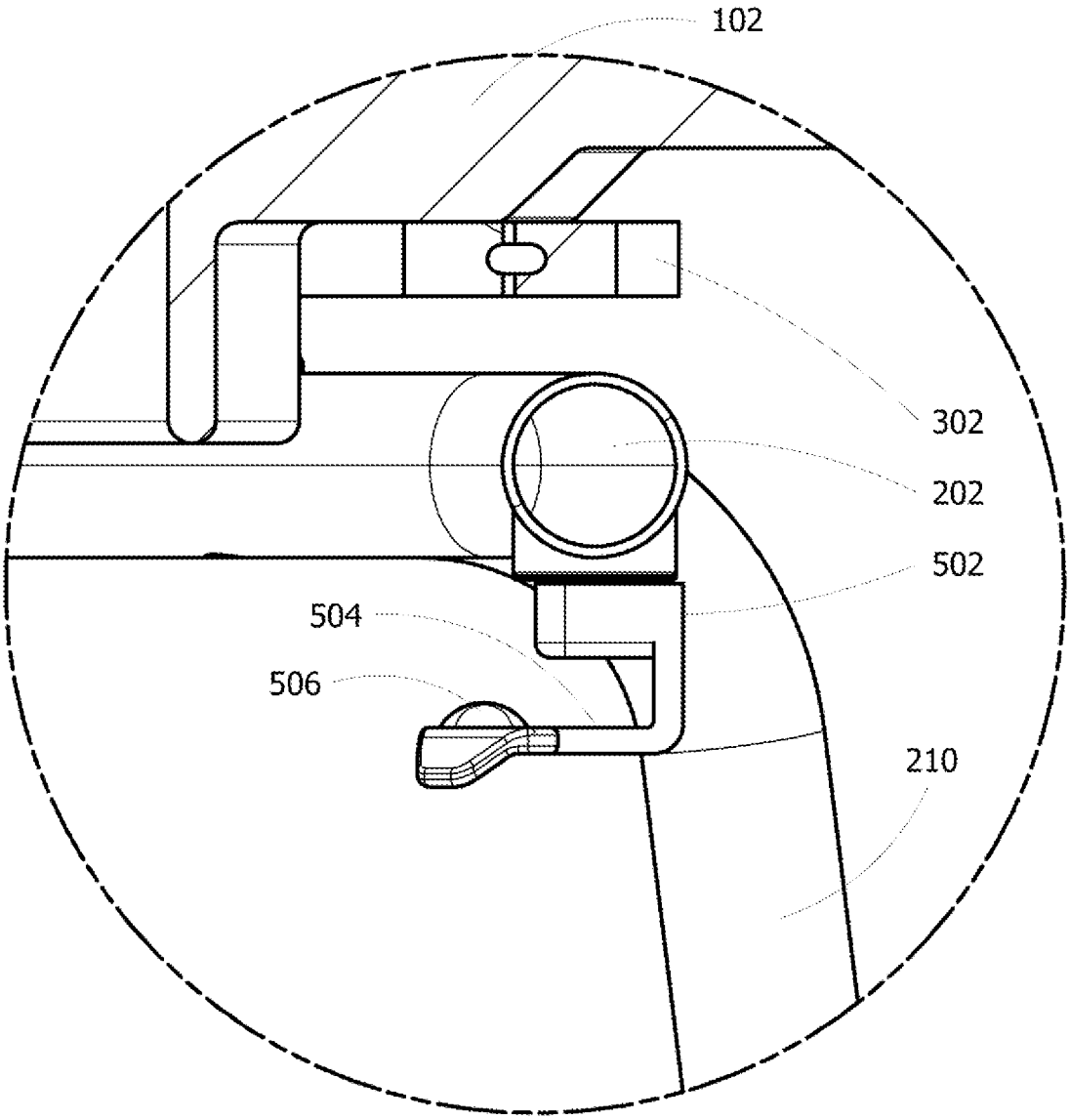
FIG. 14 is a zoomed in view of the stationary frame and elongated member, without the bucket as depicted in FIG. 13.

Bucket 402 is slidably engaged with the stationary frame 202 through commode guide assembly 502. As shown in FIGS. 11-14, commode guide assembly 502 is secured to stationary frame 202. FIG. 14 shows a zoomed in cross section of the stationary frame 202 of commode guide assembly 502, without bucket 402 engaged. Also shown in FIG. 14 is guide contact 504. Guide contact 504 interacts with rim contact 406 of bucket 402. To engage bucket 402 onto the stationary frame, the rim 404 portion of bucket 402 is slid slightly over guide contact 504 of commode guide assembly 502. This interaction allows bucket 402 to be slid into and out of the lower section of the swivel commode chair 100. Guide assembly 502, connected to stationary frame 202, supports bucket 402 when the bucket 402 is engaged in the lower section of the swivel commode chair 100.

In an exemplary embodiment, when rim 404 is slid onto commode guide assemble 502 and rim contact 406 contacts guide contact 504, rim 402 is guided by rim opening 410 following the path over guide dimple 506. See FIGS. 14 and 17. Dimple 506 is not viewable in FIG. 8 as the cross section of swivel commode chair 100 occurs in front of dimple 506.

Bucket 402 is slid onto the commode guide assembly 502, with the top opening of the bucket 402 positioned underneath opening 104 of base 102. See FIGS. 3-6. When a person 602 sits on base 102 when the removable insert 108 is not engaged on base 102 (i.e., the removable insert 108 is stored away from base 102) the person's buttocks is positioned within or on top of the opening 104 of base 102. See FIG. 22. With bucket 402 engaged below opening 104, the person is able to deposit human waste, such as feces or urine, from their body (e.g., the person's anus, penis, or vagina), through opening 104, and into bucket 402. The person should have his/her pants and underwear removed or lowered to deposit waste product into bucket 402. Bucket 402 is engaged on the lower section of the swivel commode chair 100, which is stationary (i.e., does not rotate) relative to the rotatable upper section.

Figure 18:
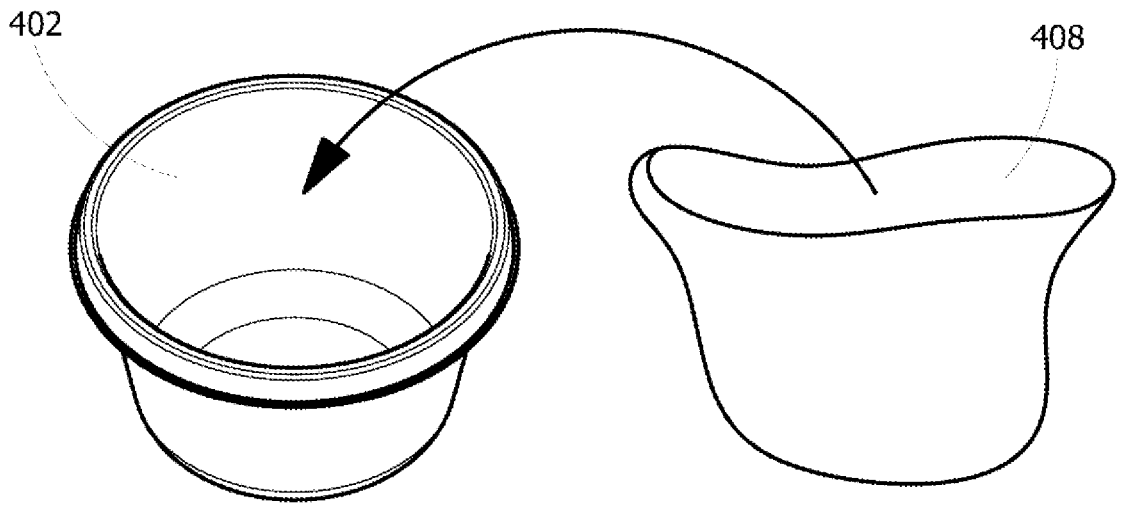
FIG. 18 is a front perspective view of a disposable waste bag being inserted into the interior of the bucket.
Figure 19:
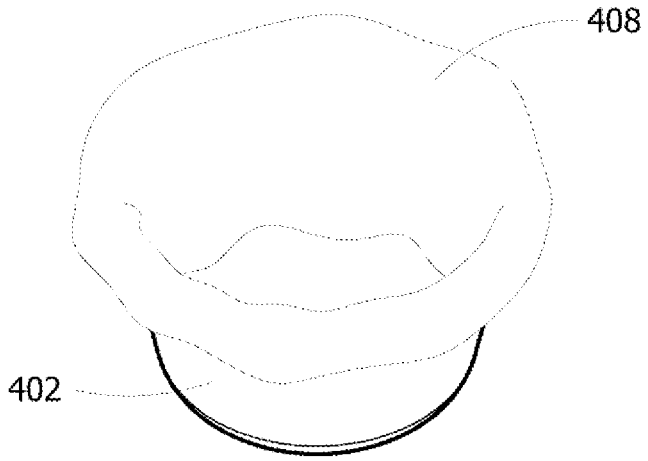
FIG. 19 is a front perspective view of a disposable waste bag after the disposable waste bag is interested in the bucket.

In an exemplary embodiment, as shown in FIGS. 18 and 19, a disposable waste bag 408 is placed within bucket 402. When disposable waste bag 408 is in place, the human waste deposited into the disposable waste bag 408 within bucket 402 is easily discarded without soiling the actual bucket 402 surface. Once discarded, a new disposable waste bag 408 is lined within bucket 402, bucket 402 is re-inserted onto commode guide assembly 502, and ready for a new deposit of human waste.

In an exemplary embodiment, the height of legs 206 (which are adjustable) is greater than the height of the bucket 402 engaged in the commode guide assembly 502.

When a person seeks to use the swivel commode chair 100 to expel human waste, the person removes the removable insert 108 and sits on the base 102 with bucket 402 positioned under the opening 104. However, the swivel commode chair can also be used as a regular seat when removable insert 108 is placed within opening 104. When used as a regular seat, the bucket 402 can be slidably engaged relative to the commode guide assembly 502, or the bucket 402 can be removed and stored for later use. If the bucket 402 is in engaged on commode guide assembly 502 when used as a regular seat with removable insert engaged on base 102, a person can easily remove the removable insert 108 when the need arises to deposit human waste in bucket 402 through opening 102.

In an exemplary embodiment, the profile of the opening depicted in FIG. 3 continues to the front and back sides of base 102. As shown in FIGS. 3 and 9, these extended cutouts 120 provide space for the person sitting on base 102 to wipe his/her genitals with his/her hands while sitting on base 102 and the removable insert 108 is not engaged. Some people may not be able to easily lift their body from the base 102. The extended cutouts 120 allow the person to wipe his/her genitals with toilet paper, tissues, wipes, or other cleaning products in the front of their body through the front extended cutout 120 by the front of base 102, or behind their body through the back extended cutout 120 by the rear of base 102.

In an exemplary embodiment, the person utilizes the following steps to use the swivel commode chair 100. A person guides bucket 402 onto the swivel commode chair 100 using commode guide assembly 502. Bucket 402 is positioned underneath opening 104. If the removable insert 108 is engaged with base 102, the person removes the removable insert 108. A person sits on base 102 of swivel commode chair 100, without the removable insert 108 (i.e., removable insert 108 is not engaged into base 102). The person deposits human waste (e.g., urine or feces) through opening 104 in base 102 into bucket 402 removably connected to commode guide assembly 502 of the swivel commode chair 100. After the human waste is deposited into bucket 402, with or without disposable waste bag 408, the person removes bucket 402 from swivel commode chair 100 to dispose of the human waste. Once the human waste is removed, either through removing the disposable waste bag 408 from bucket 402, or by cleaning bucket 402, bucket 402 (and optional disposable waste bag 408) is slid back onto the commode guide assembly 502 of the swivel commode chair 100.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A swivel commode chair, comprising:

an upper section, wherein the upper section includes a base, a first opening in the base, and at least one of the following: an adjustable back support or at least one arm rail;

a stationary frame, wherein the upper section is rotatably connected to the stationary frame;

at least one elongated member extending downward from the stationary frame;

a bucket removably connected to the stationary frame;

the base of the upper section connected to the stationary frame by at least one rotatable ring with a second opening; and the at least one rotatable ring configured to allow passage of human waste through the first opening of the base and the second opening of the at least one rotatable ring.

2. The swivel commode chair as recited in claim 1, further comprising:

a commode guide assembly connected to the stationary frame wherein the commode guide assembly supports the bucket.

3. The swivel commode chair as recited in claim 2, wherein the bucket is slidably engaged with the commode guide assembly.

4. The swivel commode chair as recited in claim 3, wherein a rim contact on the bucket engages with a guide contact of the commode guide assembly.

5. The swivel commode chair as recited in claim 1, wherein:

a removable insert covers the first opening of the base of the upper section; and the base of the upper section is unitary.

6. The swivel commode chair as recited in claim 5, wherein at least one insert dimple is located on the removable insert to disengage the removable insert from the upper section.

7. The swivel commode chair as recited in claim 5, where the bottom edge of the removable insert and the top edge of the opening of the upper section are contoured; and the contour having a convex complexion.

8. The swivel commode chair as recited in claim 1, further comprising a disposable waste bag located inside the bucket.

9. The swivel commode chair as recited in claim 1, wherein the bucket is positioned underneath the opening of the upper section.

10. The swivel commode chair as recited in claim 1, further comprising a plurality of elongated members.

11. A swivel commode chair, comprising:

an upper section;

the upper section having a first opening within a base, and at least one of the following:

an adjustable back support or at least one arm rail;

the first opening wherein a removable insert is removably connected to the base to cover the first opening;

a lower section, wherein the upper section rotates relative to the lower section using at least one rotatable ring; and the at least one rotatable ring has a second opening, wherein the diameter of the second opening is defined by the width of the first opening in the base;

a bucket with a third opening at the top of the bucket slidably engaged to the base, wherein the first opening of the base, second opening of the at least one rotatable ring, and third opening are vertically aligned for the deposit of human waste into the interior bottom of the bucket.

12. The swivel commode chair as recited in claim 11, wherein the top surface of the removable insert is flush with the top surface of the upper section when the removable insert is engaged with the upper section.

13. The swivel commode chair as recited in claim 11, further comprising an adjustable back support.

14. The swivel commode chair as recited in claim 11, further comprising adjustable elongated members connected to a stationary frame.

15. The swivel commode chair as recited in claim 11, wherein the bottom outer edge of the removable insert and the top edge of the opening of the upper section are contoured; the contour having a convex complexion.

16. A method of a person using a swivel commode chair, comprising:

sitting on a base of the swivel commode chair; and depositing human waste through an opening in the upper section into a bucket removably connected to the swivel commode chair.

17. The method as recited in claim 16, further comprising guiding the bucket onto the swivel commode chair.

18. The method as recited in claim 16, further comprising removing the bucket from the swivel commode chair to dispose the human waste.

19. The method as recited in claim 16, further comprising removing a removable insert on the upper section prior to the person sitting on the upper section.

20. The swivel commode chair as recited in claim 7, wherein the top edge of the opening of the upper section slopes into contoured cutouts at the front and back side of the upper section.

* * * * *